US007013821B2

(12) United States Patent
Sakurai

(10) Patent No.: US 7,013,821 B2
(45) Date of Patent: Mar. 21, 2006

(54) APPARATUS AND METHOD FOR CLEANING OBJECT FLOATING AT THE SURFACE OF WATER

(76) Inventor: Jiro Sakurai, 10-23, Sagisu 2-chome, Fukushima-ku, Osaka-shi, Osaka 553-0002 (JP)

( * ) Notice: Subject to any disclaimer, the term of this patent is extended or adjusted under 35 U.S.C. 154(b) by 0 days.

(21) Appl. No.: 10/494,939

(22) PCT Filed: Nov. 9, 2001

(86) PCT No.: PCT/JP01/09825

§ 371 (c)(1),
(2), (4) Date: Oct. 25, 2004

(87) PCT Pub. No.: WO03/039947

PCT Pub. Date: May 15, 2003

(65) Prior Publication Data

US 2005/0039659 A1 Feb. 24, 2005

(51) Int. Cl.
*B63B 59/00* (2006.01)

(52) U.S. Cl. ..... 114/222; 134/108

(58) Field of Classification Search ..... 114/222; 405/63, 64, 65, 66, 68; 134/107, 108, 109
See application file for complete search history.

(56) References Cited

U.S. PATENT DOCUMENTS 3,205,851 A * 9/1965 Wiswell, Jr. ..... 114/222
4,215,644 A * 8/1980 Jackson ..... 114/222
4,280,436 A * 7/1981 Jackson ..... 114/222
4,280,438 A * 7/1981 Jackson ..... 114/222
4,280,439 A * 7/1981 Jackson ..... 114/222
4,281,437 A * 8/1981 Marx ..... 114/222
4,282,822 A * 8/1981 Jackson ..... 114/222
5,152,242 A * 10/1992 Bradley ..... 114/222
5,732,646 A * 3/1998 Brandt ..... 114/222
6,327,991 B1 * 12/2001 Eichert ..... 114/222

FOREIGN PATENT DOCUMENTS

JP 58-188784 A1 11/1983
JP 60-240775 A1 11/1985
JP 02-296593 A1 12/1990
JP 04-083888 A1 3/1992

(Continued)

OTHER PUBLICATIONS

International Search Report for PCT/JP01/09825 mailed on Feb. 26, 2002.

*Primary Examiner*—Lars A. Olson
(74) *Attorney, Agent, or Firm*—Rader, Fishman & Grauer PLLC

(57) ABSTRACT

An apparatus for cleaning an object floating at the surface of water, e.g., a ship floating on the sea with ease and efficiency by use of a small amount of a cleaning agent is provided. This apparatus comprises a waterproof sheet having an area of covering a region to be cleaned of the object, and a buoyancy bag at its peripheral edge, air supply unit for supplying air into the buoyancy bag of the waterproof sheet laid under the object floating at the surface of water to float the waterproof sheet, so that a pool for accommodating the object is formed by the waterproof sheet, and a spacer for creating a clearance being filled with the cleaning agent between the waterproof sheet and the object accommodated in the pool. According to this apparatus, it is possible to clean the object floating at the surface of water on the spot without landing the object.

11 Claims, 4 Drawing Sheets

FOREIGN PATENT DOCUMENTS

| | | | |
|---|---|---|---|
| JP | 06-042591 | U1 | 6/1994 |
| JP | 06-153757 | A1 | 6/1994 |
| JP | 07-109499 | A1 | 4/1995 |
| JP | 11-217097 | A1 | 8/1999 |
| JP | 2000-063890 | A1 | 2/2000 |
| JP | 3069506 | U1 | 3/2000 |

* cited by examiner

APPARATUS AND METHOD FOR CLEANING OBJECT FLOATING AT THE SURFACE OF WATER

TECHNICAL FIELD

The present invention relates to apparatus and method for cleaning an object floating at the surface of water, e.g., a ship floating on the sea with ease and efficiency on the spot without landing the object.

BACKGROUND ART

It is known that marine organisms comprising shells such as acorn shell and blue mussel and algae adhered to a ship floating on the sea lead to an increase in seawater resistance to the movement of the ship, so that the sailing speed considerably lowers. In addition, the adhered marine organisms become a cause of corrosion of the ship body. Due to these reasons, the removal of the adhered marine organisms is very important work to save fuel cost required for the movement of the ship, and provide safe voyage.

In the past, various kinds of approaches have been proposed to prevent the adherence of marine organisms. For example, Japanese Patent Early publication No. 4-83888 discloses a method of preventing the adherence of marine organisms by use of active ions generated by loading a DC current to an electrode body to perform electrolytic process of seawater. In addition, Japanese Patent Early publication No. 60-240775 discloses using an antifouling paint obtained by compounding a swellable high molecular material with rubber or synthetic resin as a ship's-bottom coating material.

However, even when using these techniques, it is difficult to perfectly prevent the adherence of marine organisms to the ship's body, screw, screw shaft, rudder and so on. In addition, some of the conventional antifouling paints for preventing the adherence of marine organisms give a bad influence on marine environment. Moreover, although the frequency of performing the cleaning operation of the ship can be decreased to a certain degree by preventing the adherence of marine organisms, it is still required to transport the ship to a dry dock after the long-term use of the ship and perform an operation of physically removing the adhered marine organisms. Since the operation of removing the adhered marine organisms from the ship transported to the dry dock is manual labor, the dock charge and the labor cost become a large burden. In particular, the removal of the marine organisms tightly adhered to the ship's body is a long-haul hard work. In addition, when the ship's-bottom coating material is removed together with the marine organisms, it leads to the occurrence of rust in the ship's body.

Therefore, it is expected to develop cleaning apparatus and method, which has the capability of removing marine organisms with ease and efficiency, while preventing damage to the painted surface of the ship's body, and reducing the cost required for the cleaning operation of the ship.

SUMMARY OF THE INVENTION

A primary concern of the present invention is to provide an apparatus for cleaning an object floating at the surface of water, e.g., a ship floating on the sea with ease and efficiency on the spot without landing the object.

That is, the apparatus of the present invention comprises a waterproof sheet having an area of covering a region to be cleaned of the object floating at the surface of water, and a buoyancy bag at a peripheral edge portion thereof; air supply means for supplying air into the buoyancy bag of the waterproof sheet laid under the object floating at the surface of water to float the waterproof sheet, so that a pool for accommodating the object therein is formed by the waterproof sheet; and a spacer for creating a clearance being filled with a cleaning agent between the waterproof sheet and the object accommodated in the pool of the waterproof sheet.

According to the cleaning apparatus described above, for example, when the object to be cleaned is a ship floating on the sea, it is not needed to transfer the ship in a dock in order to perform the cleaning operation of the ship. Therefore, it is possible to remarkably reduce the cost and time required for the cleaning operation. In addition, since the clearance between the object to be cleaned and the waterproof sheet is stably kept by the spacer, it is possible to bring the object into contact with a suitable amount of the cleaning agent, and save the amount used of the cleaning agent.

It is preferred that the spacer and/or the buoyancy bag is integrally formed with the waterproof sheet by sewing a waterproof fabric. In this case, it is possible to skip an operation of attaching the buoyancy bag and the spacer to the waterproof sheet. In addition, since an operation of placing the waterproof sheet under the object to be cleaned becomes easy, it is possible to further improve the cleaning efficiency. Moreover, there is another advantage that the waterproof sheet is handy to carry and store.

It is also preferred that the spacer is provided by a frame structure, which has a shape of surrounding the object such that the object is spaced from the frame structure by a required distance. In this case, since the clearance between the waterproof sheet and the object is maintained constant by the frame structure, it is useful to achieve a uniform cleaning effect.

It is further preferred that the waterproof sheet has a cut portion at a location corresponding to at least one of front and rear ends of the object to be cleaned, and joint means with waterproofing capability formed at both edges of the cut portion, and the both edges of the cut portion are coupled by the joint means to obtain the pool around the object. For example, when the object to be cleaned is a ship, the waterproof sheet has a sufficient area of surrounding a region from the ship' bottom to above the waterline of the ship, and a cut portion is formed at a location corresponding to at least one of the bow and stern sides of the ship. In addition, the joint means such as a waterproof fastener is formed at both edges of the cut portion. By coupling the both edges of the cut portion with the waterproof fastener, the pool of the waterproof sheet for accommodating the ship therein is obtained. By the formation of this pool, the ship to be cleaned is separated from the outside seawater. In addition, by supplying the air into the buoyancy bag to float the waterproof sheet, it is possible to efficiently form the pool of the waterproof sheet around the ship. In particular, by coupling the both edges of the cut portion by the joint means when the waterproof sheet reaches a required floating position, it is possible to reduce the amount of water that inevitably flows into the pool.

In addition, it is preferred to form drain means of removing water from around the object in the pool to the outside of the pool. This component is effective to perform a cleaning operation comprising the steps of discharging water (seawater) inevitably caught in the pool, and then filling the cleaning agent with a controlled composition in the pool.

In addition, it is preferred that the waterproof sheet comprises a supply valve for supplying the cleaning agent into the pool, and a drain valve for removing the cleaning agent from the pool, and the apparatus further comprises cleaning agent supply means for supplying the cleaning agent through the supply valve, and circulation means for returning the cleaning agent removed through the drain valve to the cleaning agent supply means. In this case, it is possible to stably bring the object to be cleaned into contact with a fresh cleaning agent. Moreover, since a higher detergency is obtained in a flowing state of the cleaning agent as compared with a static state of the cleaning agent, it is possible to more effectively perform the cleaning operation. To obtain an improved flowing state of the cleaning agent, a stirrer for enhancing the flowing state of the cleaning agent in the pool may be used.

Moreover, it is preferred that the waterproof sheet comprises a first waterproof sheet for a forward end of the object to be cleaned, a second waterproof sheet for a rearward end of the object, and at least one of third waterproof sheet connected between the first and second waterproof sheets by joint means with waterproofing capability. For example, when the object to be cleaned is a ship, the waterproof sheet is composed of the first waterproof sheet for the bow side of the ship, the second waterproof sheet for the stern side of the ship, and at least one of the third waterproof sheet connected between the first and second waterproof sheets by the joint means with waterproofing capability such as a waterproof fastener. In this case, a total length of the waterproof sheet is adjustable depending on the length of the ship to be cleaned. Therefore, it is possible to cope flexibly with various kinds of the ship's shape.

Another concern of the present invention is to provide a method for cleaning an object floating at the surface of water, e.g., ships floating on the sea with ease and efficiency on the spot without landing the object.

That is, the cleaning method of the present invention comprises the steps of:

setting a waterproof sheet under the object floating at the surface of water, the waterproof sheet having an area of covering a region to be cleaned of the object, and a buoyancy bag at a peripheral edge portion thereof;

supplying air into the buoyancy bag to float the waterproof sheet, so that a pool for accommodating the object therein is formed by the waterproof sheet; and filling a cleaning agent in a clearance between the waterproof sheet and the object accommodated in the pool of the waterproof sheet.

To further improve the cleaning efficiency, it is particularly preferred to comprise the step of forcedly circulating the cleaning agent in the pool.

Other features and advantages will be clearly understood from the best mode for carrying out the invention described below, referring to the attached drawings.

BEST MODE FOR CARRYING OUT THE INVENTION

As a preferred embodiment of a cleaning apparatus of the present invention, apparatus and method for removing adhered marine organisms from a ship are explained in detail.

Figure 1A:
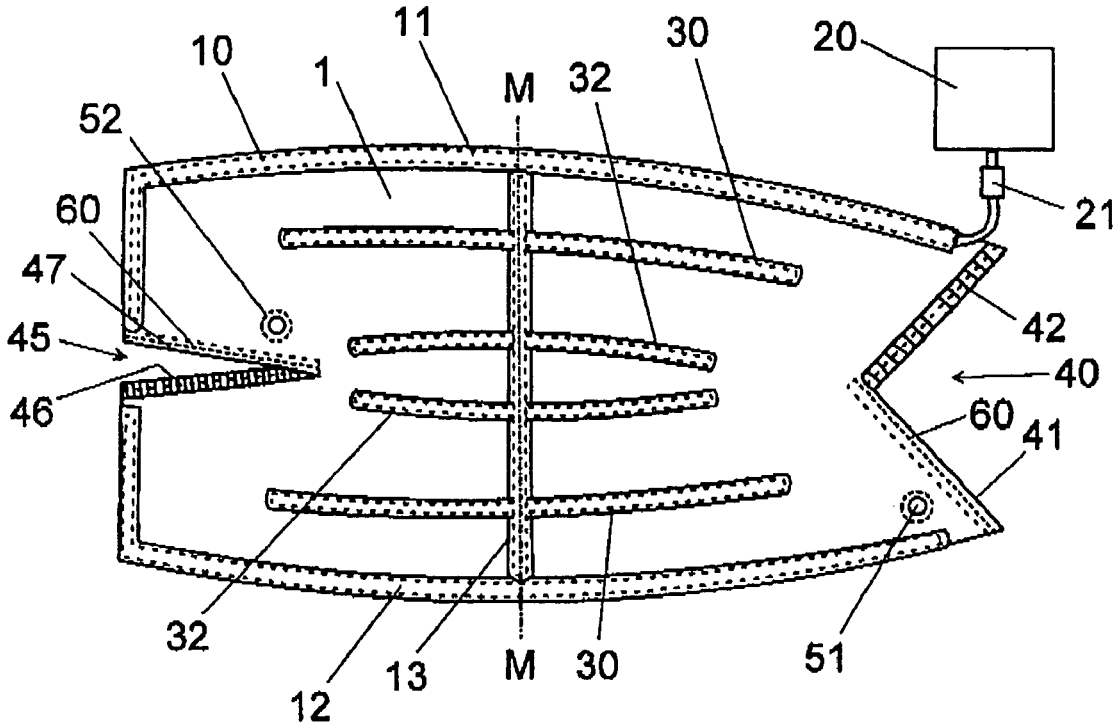
FIG. 1A is a top view of a waterproof sheet with buoyancy bags of a cleaning apparatus according to a first embodiment of the present invention.

As shown in FIG. 1A, the cleaning apparatus of the present embodiment is mainly composed of a waterproof sheet 1 having an area of covering a region to be cleaned of a ship, i.e., the region from the ship's bottom to above the waterline of the ship, buoyancy bags 10 formed at peripheral edges of the waterproof sheet, air pump 20 for supplying air into the buoyancy bags as air supply means, and a spacer (30, 32) formed at required positions of the waterproof sheet 1.

A material of the waterproof sheet 1 is not limited to a specific one. It is preferred to select a material having the durability to an acidic cleaning agent described later as well as excellent waterproof property of preventing the inflow of seawater. For example, it is possible to use a marketed waterproof fabric (manufactured by TEIJIN LIMITED), which is excellent in water resistance, resistance to chemicals such as cleaning agents, and wear resistance of preventing the occurrence of damage by sharp edges of shells.

In this embodiment, the buoyancy bags 10 are integrally formed with the waterproof sheet by sewing a waterproof fabric of the waterproof sheet. The buoyancy bags 10 is composed of a pair of first and second buoyancy bags 11, 12 provided at peripheral edges of the waterproof sheet. The first buoyancy bag 11 is coupled to the second buoyancy bag 12 by an air supply tube 13. Since the first and second buoyancy bags 11, 12 are positioned at the vicinity of the waterline of the ship when the cleaning operation of the ship is performed, it is possible to effectively prevent the afflux of seawater into the pool of the waterproof sheet 1.

In addition, when the air is supplied into the first buoyancy bag 11 through an air intake 21 by the air pump 20, the supplied air is also sent to the second buoyancy bag 12 through the air supply tube 13. Thus, since the air can be supplied to all of the buoyancy bags 10 at a time, a preliminary work for cleaning becomes easier as compared with the case of individually supplying the air into the buoyancy bags.

Figure 1B:
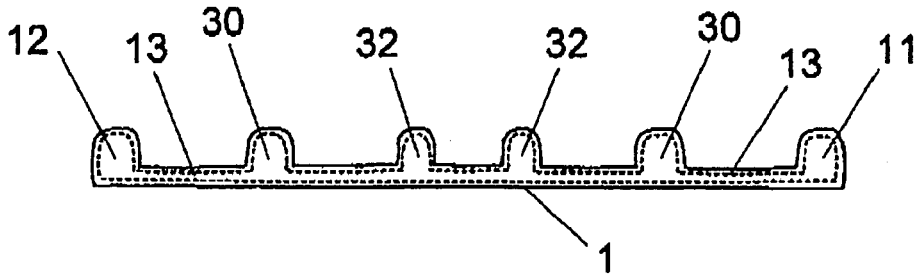
FIG. 1B is a cross-sectional view taken along the line M—M of FIG. 1A, FIGS. 2A to 2C are side, front and rear views of an object (boat) to be cleaned accommodated in the cleaning apparatus of the present invention.

Thus, the air supply tube 13 functions as a tube for supplying the air from the first buoyancy bag 11 to the second buoyancy bag 12. As shown in FIG. 1B, the air supply tube 13 is designed to be smaller in height than the first and second buoyancy bags 11, 12. Thereby, it is possible to avoid a situation that a flowage of the cleaning solution is inhibited by accidental contact of the air supply tube 13 with the ship's body during the cleaning operation. The number, shape and size of buoyancy bags can be determined depending on the size of a ship to be cleaned. Alternatively, the buoyancy bags may be detachably attached to the waterproof sheet.

Figure 2A:
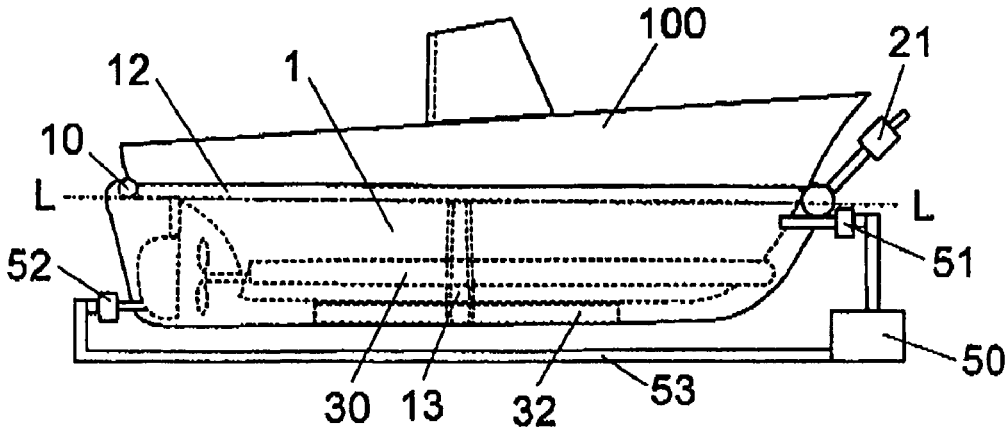
Figure 2B:
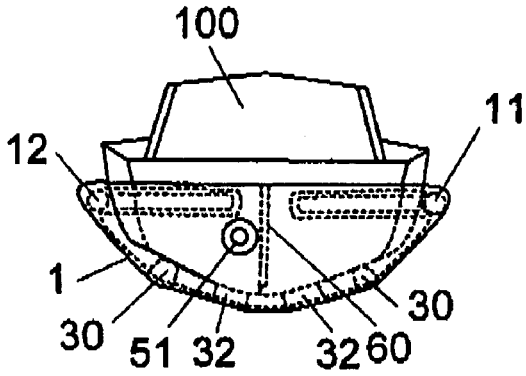
Figure 2C:
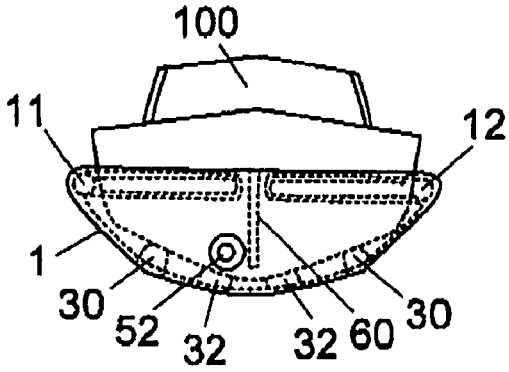

As shown in FIG. 1A, the waterproof sheet 1 has V-shaped cuts 40, 45 at locations corresponding to the bow and stern of the ship to be cleaned. A waterproof fastener 60 is formed at both edges (41, 42, 46, 47) of the respective cuts. When the both edges (41, 42, 46, 47) of the respective cuts are closed by the waterproof fastener 60, a pool of the waterproof sheet 1 is obtained, as shown in FIGS. 2A to 2C. Therefore, the ship accommodated in this pool is separated from the outside seawater by the waterproof sheet 1.

In addition, the waterproof sheet 1 has a supply valve 51 connectable with an supply pump 50 for providing the cleaning agent into the pool of the waterproof sheet, and a drain valve 52 for removing the cleaning agent from the pool. The cleaning agent removed through the drain valve 52 is returned to the supply pump 50 through a circulation line 53 formed by a hose and so on, so that a flowing state of the cleaning solution is actualized in the pool. To facilitate the flowing state of the cleaning solution in the pool, a stirrer may be used.

In this embodiment, the spacers (30, 32) are provided by buoyancy bags integrally formed with the waterproof sheet 1 by sewing a waterproof fabric of the waterproof sheet. The air is supplied into these buoyancy bags (30, 32) through the air supply tube 13. That is, when the air is supplied into the first buoyancy bag 11 through the air intake 21 by the air pump 20, the air is simultaneously supplied to the buoyancy bags (30, 32) as the spacers and the second buoyancy bag 12 through the air supply tube 13. Therefore, it is possible to efficiently supply the air into all of the buoyancy bags (11, 12, 30, 32) formed on the waterproof sheet. If necessary, a spacer(s) made of a cushioning light-weight material having a buoyant force such as polystyrene foam may be detachably attached to the waterproof sheet.

There is no limitation on the height of the spacer (30, 32). From the viewpoint of filling a sufficient amount of the cleaning agent in the clearance between the waterproof sheet and the object to be cleaned, it is preferred that the height is in a range of 100 to 200 mm, and more preferably 100 to 150 mm. In this embodiment, as shown in FIGS. 2B and 2C, the spacer 30 provides a required clearance between the ship's side and the waterproof sheet 1, and the spacer 32 provides a required clearance between the ship's bottom and the waterproof sheet 1. When the cleaning solution is filled in the clearance created by these spacers between the ship's body 100 and the waterproof sheet 1, it is possible to bring the ship's body into contact with an optimum amount of the cleaning solution, and therefore prevent the use of an excessive amount of the cleaning solution. In addition, the spacers do not interfere with a flow of the cleaning solution in a longitudinal direction of the ship. The number, shape and size of the spacers can be determined depending on the size of a ship to be cleaned.

By use of the cleaning apparatus described above, a method for cleaning a ship 100 floating on the sea is explained below. First, the waterproof sheet 1 is placed under the ship 100 floating on the sea. Then, the air is supplied to the buoyancy bags 10 by the air pump 20 to float the waterproof sheet in the seawater. After the buoyancy bags 10 float at a position of the waterline L of the ship 100, the cuts (41, 42, 46, 47) are closed at the bow and stern sides of the ship by use of the waterproof fasteners 60, so that the ship 100 is accommodated in the pool of the waterproof sheet. Thus, the ship 100 to be cleaned is separated from the outside seawater by the pool of the waterproof sheet 1.

By the way, when the waterproof sheet 1 floats, a part of the seawater around the ship is inevitably taken in the pool. The seawater taken in the pool can be used as a diluent for the cleaning agent. Alternatively, after removing the seawater in the pool, a cleaning solution having a regulated composition may be filled in the pool. In this embodiment, the seawater taken in the pool is discharged by use of a drain pump (not shown), and then the cleaning solution having the required composition is supplied.

The cleaning agent is not limited to a specific one. However, it is preferred to use a cleaning agent having the capability of effectively removing marine organisms from steel ships without causing corrosion and hydrogen embrittlement of the ship's body. As such a cleaning agent, for example, it is recommended to use the cleaning agent having a composition of 70 to 90 wt % of sulfamic acid, 5 to 15 wt % of citric acid and 5 to 15 wt % of malic acid. This cleaning agent is usually diluted with water or seawater, and used as an aqueous solution.

Next, the cleaning solution is supplied into the pool from the supply valve 51 located at the bow side of the waterproof sheet 1. After the pool is filled with a required amount of the cleaning solution, the cleaning solution is discharged from the drain valve 52 located at the stern side, while the supply of the cleaning solution through the supply valve 51 being continued. After impurities are removed from the discharged cleaning solution by a strainer, the cleaning solution is returned to the supply pump 50 through the circulation line 53, and supplied again into the pool through the supply valve 51. Thus, by circulating the cleaning solution in the pool of the waterproof sheet 1, a flowing state of the cleaning solution is obtained. Therefore, the ship's body can be placed in the cleaning solution flowing at a required flow velocity, so that the cleaning solution in the flowing state successively contacts the marine organisms adhered to the ship's body. At this time, it is expected that the adhered marine organisms are physically ripped off by the flow of the cleaning solution. Thus, it is possible to obtain a higher cleaning effect, and complete the cleaning operation in a shorted time period.

Alternatively, the cleaning solution may be injected into the pool from the bow side, and discharged from a valve positioned in the vicinity of the waterline at the stern side. In place of the above case of making a flow of the cleaning solution in a direction from the bow side to the stern side, the flow of the cleaning solution may be formed in a direction from the stern side to the bow side. Moreover, in place of the formation of one-way flow of the cleaning solution in the pool, at least one stirrer may be disposed in the pool such that a uniform flow of the cleaning solution is obtained over the entire region of the pool. Depending on the shape and size of the object to be cleaned, an additional pump may be adopted to obtain an improved flow state of the cleaning solution.

Figure 3:
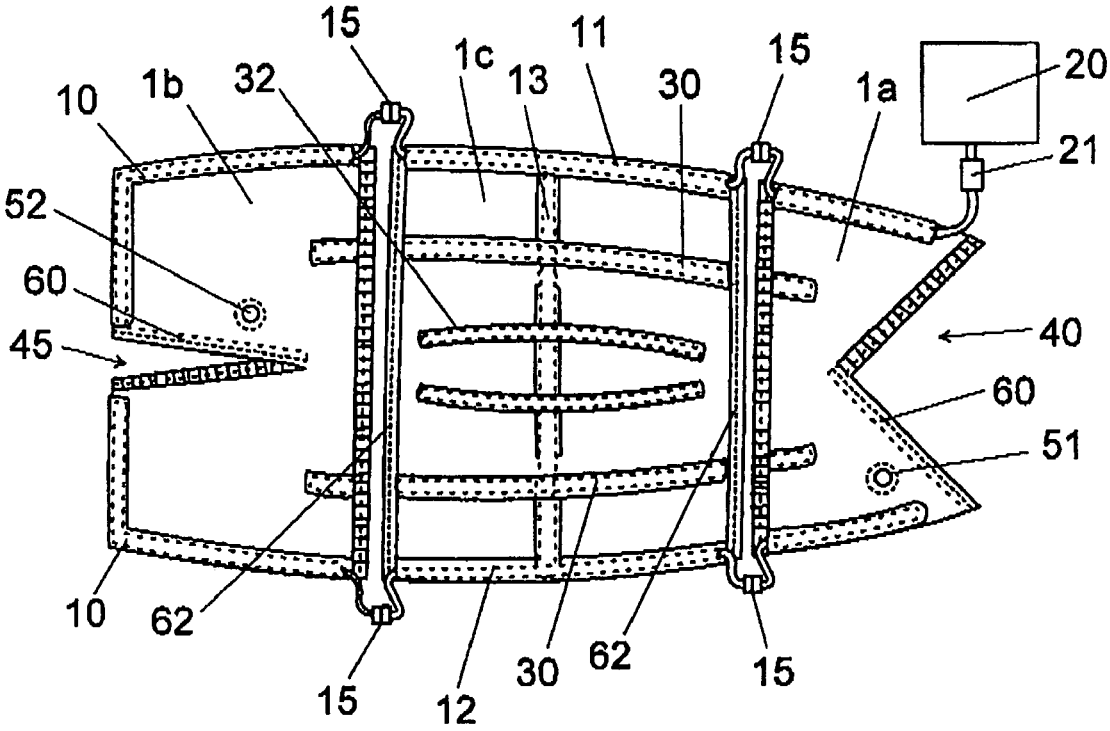
FIG. 3 is a top view showing a modification of a waterproof sheet with buoyancy bags of the cleaning apparatus of the present invention.

As a modification of the waterproof sheet 1 of the present invention, it is possible to use a waterproof sheet composed of a first waterproof sheet 1*a* for the bow, a second waterproof sheet 1*b* for the stern, and at least one of third waterproof sheet 1*c* connected between the first and second waterproof sheets by joint means 62 with waterproofing capability such as waterproof fastener. In this case, it is possible to cope flexibly with cleaning operations of ships having different lengths by exchanging the third waterproof sheet corresponding to the midsection of the ship with another third waterproof sheet, or coupling a plurality of third waterproof sheets between the first and second waterproof sheets. That is, a region below the waterline of the ship is usually equivalent to ¼ to ⅕ of the height of the ship. Therefore, by adequately designing a depth of a submerged portion of the waterproof sheet, it is possible to cope flexibly with the cleaning operations of ships having different sizes by use of these separable waterproof sheets. In FIG. 3, the numeral 15 designates a connector for coupling the buoyancy bags 10 between the first waterproof sheet 1*a* and the third waterproof sheet 1*c* or between the second waterproof sheet 1*b* and the third waterproof sheet 1*c*. The other configurations are substantially the same as the waterproof sheet 1 of FIG. 1.

Figure 4:
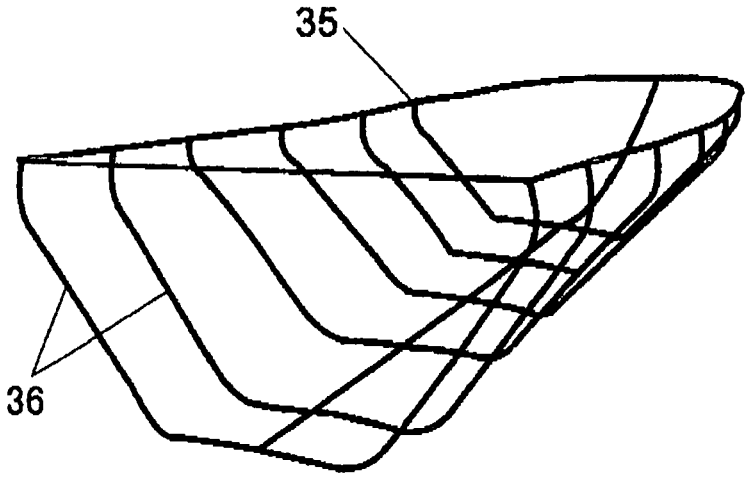
FIG. 4 is a perspective view of a frame structure as a modification of spacers of the cleaning apparatus.

In place of the waterproof sheet 1 having the buoyancy bags as the spacers (30, 32) explained referring to FIGS. 1 and 3, a frame structure 36 shown in FIG. 4 may be used.

Figure 5A:
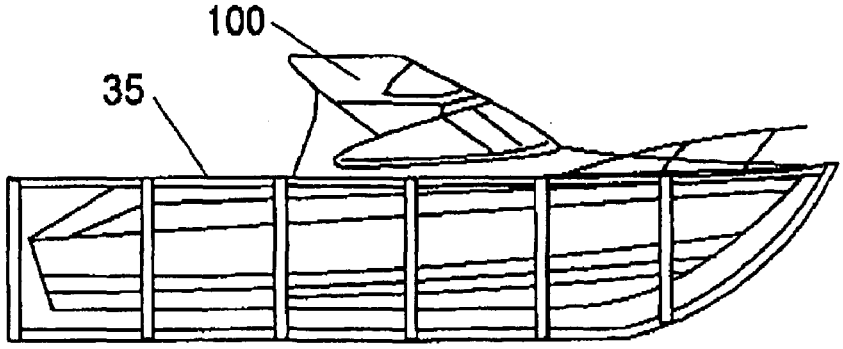
FIGS. 5A and. 5B are side and top views showing the frame structure secured to the object (boat)
Figure 5B:
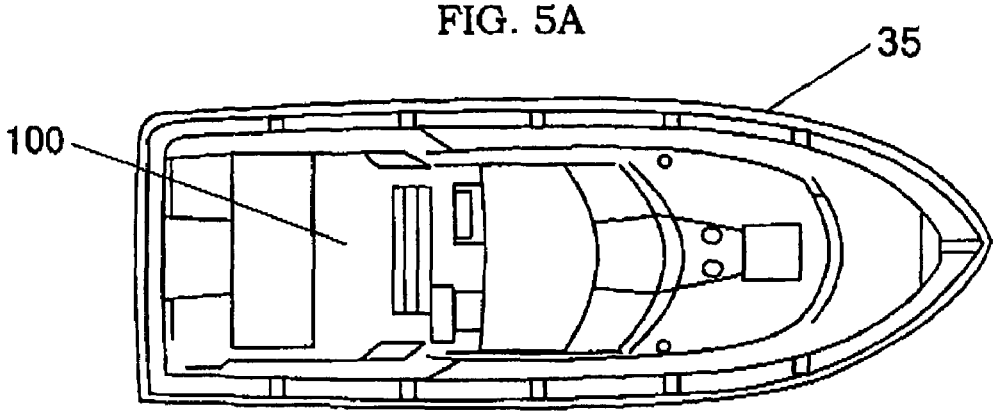

This frame structure 35 can be assembled to have a sufficient size of surrounding a region from the ship's bottom to the vicinity of the waterline L by use of vinyl chloride pipes 36 or rods having a diameter of 100 to 150 mm. As the material of the frame structure 35, a light-weight material having good connectivity with each other is available. Therefore it is not limited to a specific one. In addition, it is preferred to strengthen the frame structure 35 by use of a reinforcing pipe (not shown) having a diameter of about 40 mm. FIGS. 5A and 5B show the frame structure 35 secured to a boat 100 as the object to be cleaned. The frame structure 35 can be secured to the ship's body by required fixtures (not shown). It is also preferred that the size of the frame structure is determined such that when the frame structure is secured to the ship's body 100, a distance between the outer surface of the ship and the frame structure is in a range of 10 cm to 15 cm. Thereby, the same effects as the case of using the spacers (30, 32) can be achieved by this frame structure.

A cleaning operation using the frame structure 35 as the spacer is briefly explained. First, the frame structure 35 is secured to the object to be cleaned, e g., a ship floating on the seawater, and then the waterproof sheet 1 is placed under the frame structure 35. The air is supplied to the buoyancy bags 10 by the air pump 20 to float the waterproof sheet 1. At this time, the waterproof sheet 1 is allowed to flow along the outer periphery of the frame structure. When the buoyancy bags (11, 12) rise to the surface of the sea and reach above the waterline L of the ship 100, the waterproof sheet 1 is fixed to the ship's body 100 and the frame structure 35. Thus, by covering, with the waterproof sheet 1, the frame structure secured to the ship by the fixtures so as to be spaced from the ship's body by a constant distance, the pool for accommodating the ship's body 100 and the frame structure 35 therein can be formed. As a result, the ship's body accommodated in the pool is separated from the outside seawater by the waterproof sheet 1, and the adhered marine organisms can be removed from the ship's body according to the cleaning method described above.

Figure 6:
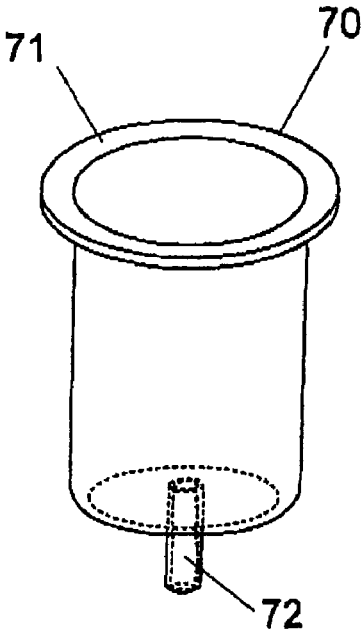
FIG. 6 is a perspective view of a waterproof bag for cleaning a specific region of the object.
Figure 7:
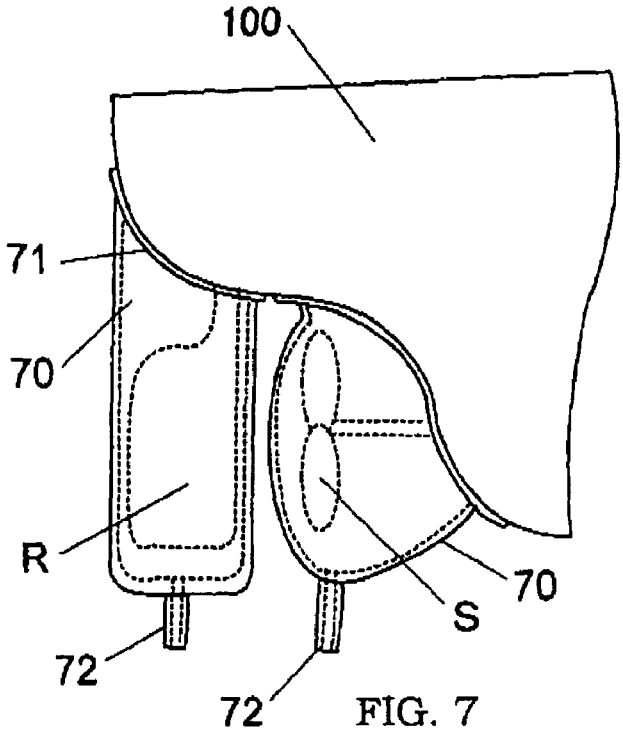
FIG. 7 is a diagram showing the "in-use state" of the waterproof bag.

If necessary, a rudder or screw with large amounts adhered of marine organisms may be intensively cleaned by use of a cleaning vessel. For example, as shown in FIG. 6, it is preferred to use a waterproof bag 70 for cleaning, which is formed by a waterproof fabric. A flange portion 71 of this waterproof bag 70 is made of a flexible plastic material or rubber, in which a magnet is embedded. As shown in FIG. 7, after the rudder R or screw S is accommodated in the waterproof bag 70, the flange portion 71 is secured to the ship's bottom by the magnet. Thereby, it is possible to separate the interior of the waterproof bag from the outside seawater. A breather valve 72 is formed at the bottom of the waterproof bag 70, which is used to inject the cleaning solution into the waterproof bag and discharge the injected cleaning solution to the outside. Thereby, it is possible to circulate the cleaning solution in the waterproof bag, and obtain higher cleaning performance.

As an example, a method of cleaning the rudder R and screw B by use of this waterproof bag 70 is explained. First, the remaining seawater in the waterproof bags 70 secured to the rudder R and screw S is discharged through the breather valve 72. Next, the cleaning solution is injected into the waterproof bag through the breather valve 72. After the elapse of a required time period, the cleaning solution is discharged outside through the breather valve 72. By repeating this discharge-injection procedure for the cleaning solution, it is possible to more efficiently perform the cleaning operation as compared with the case of maintaining a static state of the cleaning solution for an extended time period. This waterproof bag is also available when the ship is landed to repaint the ship's bottom.

EXAMPLES

An experiment of removing marine organisms adhered to a ship's body was performed by use of a cleaning apparatus shown in FIG. 1. As the object to be cleaned, a small boat having a total length of about 6 m and a width of about 2 m was used. The marine organisms adhered to an outer surface of this boat by long-term use on the sea are mainly composed of oyster and barnacle.

To perform the cleaning operation, the boat was accommodated in a pool of the waterproof sheet 1 formed by the method described above. To create a clearance being filled with a cleaning agent between the waterproof sheet and the boat, spacers having a height of 150 mm were used. As the supply pump 50 for the cleaning solution, a pump having a pumping power of 195 liter/min was used. The supply pump was fixed to a lower portion of an engine blanket of the ship to obtain a floating state of the cleaning solution in the pool. The cleaning agent used in this experiment has a pH value of 1.0, which is composed of sulfamic acid, citric acid and malic acid. In consideration of a slack of the waterproof sheet, the volume of the pool was estimated at 2 tons, and 54 kg of the cleaning agent was put in the pool. The cleaning agent was diluted with the seawater such that a concentration of the cleaning agent becomes approximately 2.7%.

By leaving the ship in the pool of the waterproof sheet for 3 hours under the above-described conditions, almost all of the adhered marine organisms were removed. In particular, the cleaning effect was high at a portion directly exposed to a flow of the cleaning solution supplied into the pool through the supply valve 51. In addition, peeling of the ship's bottom paint and the occurrence of afflux of the seawater into the pool were not observed during the cleaning operation. As a result of measuring the pH value of the cleaning solution every hour during the cleaning operation, the pH value was always kept in the range of 1 to 2. No deterioration of the cleaning solution was recognized. Thus, by using the cleaning apparatus of the present invention, an efficient removal of the adhered marine organisms from the ship's bottom was achieved without causing the peeling of the ship's bottom paint.

Next, a selective cleaning of the rudder R and screw S with gross contamination was performed by use of waterproof bags 70 for cleaning, as shown in FIG. 6. The cleaning solution used was prepared by diluting a cleaning agent having the composition of 90 wt % of sulfamic acid, 5 wt % of citric acid and 5 wt % of malic acid with water such that a concentration of the cleaning agent becomes 5 wt %. As shown in FIG. 7, after the waterproof bags 70 were attached to the rudder R and screw 8, the selective cleaning was performed for 3 hours by repeating supply and discharge of the cleaning solution. As a result, the marine organisms tightly adhered to the rudder R and screw S were completely removed by this cleaning operation. In addition, no occurrence of damage and corrosion in the metal surface of the screw and the painted surface of the rudder was observed after the cleaning operation.

INDUSTRIAL APPLICABILITY

According to the cleaning apparatus of the present invention, it is possible to efficiently perform the cleaning operation at a lower cost, as compared with the case of transporting the ship to a dry dock and then performing the cleaning operation of the ship. In particular, when using a suitable cleaning agent, and means for circulating the cleaning agent, the adhered marine organisms can be more effectively removed by leaving the object to be cleaned for a required time in the cleaning apparatus of the present invention without a bothersome work of mechanically removing the adhered marine organisms.

Thus, the cleaning operation can be easily performed at a relatively low cost in a short period of time. Therefore, it is possible to prevent a decrease in working ratio of the object, and perform the cleaning operation at regular time intervals. In addition, since the occurrence of damage to the painted surface of the ship's body is negligibly small, it is useful to provide safe voyage.

As described above, the cleaning apparatus and method of the present invention is particularly effective to remove adhered exogenous material from the ship floating on the sea. Besides, the present apparatus and method are available to other structures such as floating bridge and intake and drain pipes for seawater (secondary cooling water) used in nuclear power plants or fishing nets with adhered marine organisms as the object to be cleaned floating at the surface of water. In addition, they are useful to clean contaminations such as algae or the like adhered to the object to be cleaned, e.g., a leisure boat or pleasure boat floating on a lake or pond other than the sea.

As understood from the above explanations, the present invention possesses a high industrial value because the cleaning operation can be easily and efficiently performed on the spot without landing by use of a smaller amount of the cleaning agent as compared with the conventional cleaning operation with a lot of cost and time.

What is claimed is:

1. An apparatus for cleaning an object floating at the surface of water, said apparatus comprising:

a waterproof sheet having an area of covering a region to be cleaned of said object floating at the surface of water, and a buoyancy bag at a peripheral edge portion thereof;

an air supply unit configured to supply air into said buoyancy bag of said waterproof sheet laid under said object floating at the surface of water to float said waterproof sheet, so that a pool for accommodating said object therein is formed by said waterproof sheet; and a spacer for creating a clearance being filled with a cleaning agent between said waterproof sheet and said object accommodated in the pool of said waterproof sheets, wherein said spacer is provided by a frame structure, which has a shape of surrounding said object such that said object is spaced from said frame structure by a required distance.

2. The apparatus as set forth in claim 1, wherein said buoyancy bag is integrally formed with said waterproof sheet by sewing a waterproof fabric.

3. The apparatus as set forth in claim 1 further comprising a drain unit configured to remove water from around said object in the pool to the outside of the pool.

4. The apparatus as set forth in claim 1, wherein said cleaning agent comprises sulfamic acid, citric acid and malic acid.

5. The apparatus as set forth in claim 1, wherein said waterproof sheet has a cut portion at a location corresponding to at least one of front and rear ends of said object, and joint means with waterproofing capability formed at both edges of said cut portion, and wherein the both edges of said cut portion are coupled by said joint means to obtain the pool around said object.

6. The apparatus as set forth in claim 5, wherein said joint means comprises a waterproof fastener.

7. A method for cleaning an object floating at the surface of water, said method comprising the steps of:

setting a waterproof sheet under said object floating at the surface of water, said waterproof sheet having an area of covering a region to be cleaned of said object floating at the surface of water, and a buoyancy bag at a peripheral edge portion thereof;

supplying air into said buoyancy bag to float said waterproof sheet, so that a pool for accommodating said object therein is formed by said waterproof sheet; and filling a cleaning agent in a clearance between said waterproof sheet and said object accommodated in the pool of said waterproof sheet; and creating a flowing state of said cleaning agent in the pool.

8. An apparatus for cleaning an object floating at the surface of water, said apparatus comprising:

a waterproof sheet having an area of covering a region to be cleaned of said object floating at the surface of water, and a buoyancy bag at a peripheral edge portion thereof;

an air supply unit configured to supply air into said buoyancy bag of said waterproof sheet laid under said object floating at the surface of water to float said waterproof sheet, so that a pool for accommodating said object therein is formed by said waterproof sheet; and a spacer for creating a clearance being filled with a cleaning agent between said waterproof sheet and said object accommodated in the pool of said waterproof sheet, wherein said waterproof sheet comprises a supply valve for supplying said cleaning agent into the pool, and a drain valve for removing said cleaning agent from said pool, and wherein the apparatus further comprises cleaning agent supply unit configured to supply said cleaning agent through said supply valve and a circulation unit configured to return said cleaning agent removed through said drain valve to said cleaning agent supply unit.

9. An apparatus for cleaning an object floating at the surface of water, said apparatus comprising:

a waterproof sheet having an area of covering a region to be cleaned of said object floating at the surface of water, and a buoyancy bag at a peripheral edge portion thereof;

an air supply unit configured to supply air into said buoyancy bag of said waterproof sheet laid under said object floating at the surface of water to float said waterproof sheet, so that a pool for accommodating said object therein is formed by said waterproof sheet; and a spacer for creating a clearance being filled with a cleaning agent between said waterproof sheet and said object accommodated in the pool of said waterproof sheet; and a stirrer for creating a flowing state of said cleaning agent in the pool of said waterproof sheet.

10. The apparatus as set forth in claim 9, wherein said spacer is integrally formed with said waterproof sheet by sewing a waterproof fabric.

11. An apparatus for cleaning an object floating at the surface of water, said apparatus comprising:

a waterproof sheet having an area of covering a region to be cleaned of said object floating at the surface of water, and a buoyancy bag at a peripheral edge portion thereof;

an air supply unit configured to supply air into said buoyancy bag of said waterproof sheet laid under said object floating at the surface of water to float said waterproof sheet, so that a pool for accommodating said object therein is formed by said waterproof sheet; and a spacer for creating a clearance being filled with a cleaning agent between said waterproof sheet and said object accommodated in the pool of said waterproof sheet, wherein said waterproof sheet comprises a first waterproof sheet for a forward end of said object, a second waterproof sheet for a rearward end of said object, and at least one of third waterproof sheet connected between said first and second waterproof sheets by joint means with waterproofing capability.

* * * * *